United States Patent [19]

Yxfeldt

[11] 3,971,074

[45] July 27, 1976

[54] SHOWER-BATH ARRANGEMENT

[76] Inventor: Leif Johan Yxfeldt, Storgatan 59, 115 23 Stockholm, Sweden

[22] Filed: Oct. 29, 1974

[21] Appl. No.: 518,634

[30] Foreign Application Priority Data

Oct. 29, 1973 Sweden ..... 7314675

[52] U.S. Cl. ..... 4/145; 4/148; 4/152

[51] Int. Cl.[2] ..... A47K 3/22; A47K 3/08

[58] Field of Search ..... 4/145, 146, 147, 148, 4/151, 152, 156, 149, 153

[56] References Cited

UNITED STATES PATENTS

| | | | |
|---|---|---|---|
| 833,527 | 10/1906 | Jackson | 4/153 |
| 1,148,968 | 8/1915 | Jablonski | 4/149 |
| 1,893,435 | 1/1933 | Neal | 4/145 |
| 2,011,446 | 8/1935 | Judell | 4/145 |
| 2,685,093 | 8/1954 | Lundquist | 4/145 |
| 3,005,995 | 10/1961 | Bickford | 4/145 |
| 3,375,532 | 4/1968 | Gellmann | 4/145 |
| 3,737,107 | 6/1973 | Wright | 4/145 |
| 3,806,963 | 4/1974 | Flynn | 4/145 |
| 3,837,013 | 9/1974 | Davis et al. | 4/145 |

FOREIGN PATENTS OR APPLICATIONS

| | | | |
|---|---|---|---|
| 2,142,462 | 1/1973 | France | 4/152 |
| 1,112,245 | 3/1956 | France | 4/152 |
| 164,453 | 11/1905 | Germany | 4/152 |
| 390,813 | 8/1965 | Switzerland | 4/152 |
| 499,304 | 1/1971 | Switzerland | 4/152 |

*Primary Examiner*—Henry K. Artis
*Attorney, Agent, or Firm*—Flynn and Frishauf

[57] ABSTRACT

A shower-bath arrangement comprising a slideable member which is displaceable on a vertical support member and which is adjustable upwardly and downwardly thereon, the slideable member supporting a shower arm which is provided with shower nozzles. The slideable member is also coupled to a source of water supply. The shower arm is swingable about a substantially horizontal axis for adjusting the inclination of the shower arm relative to a horizontal plane. The shower nozzles are preferably arranged to emit substantially conical water jets and are directed such that the water jets strike one another angularly within a mixing zone located between the nozzles. Preferably, the nozzles are rotatable to locate the mixing zone either above or below the nozzles.

22 Claims, 2 Drawing Figures

SHOWER-BATH ARRANGEMENT

The present invention relates to a shower-bath arrangement, comprising a slidable member, which is displaceable on a vertical support member and which can be adjusted upwardly and downwardly thereon, said slidable member being provided with means for connection to a source of water supply and for supporting a shower arm, which is provided with shower nozzles.

BACKGROUND OF THE INVENTION

Shower-bath fixtures are previously known in many different designs, for instance comprising a connection unit, which is vertically displaceable on a post or the like and which supports a curved perforated pipe or the grip of a hand shower. There are other known shower-bath arrangements of stationary type, where shower nozzles are fixed at different heights with a certain interspace therebetween. Such prior art devices are disclosed for instance in U.S. Pat. Nos. 1,148,968 and 833,527, French patent specification No. 1,112,245 and Swiss patent specification No. 390,813.

Lately so called shower cabins have been designed, comprising a shower-bath arrangement in which the shower nozzles are positioned in each corner of the cabin and have the form of vertical pipes with perforations, which are directed to the centre of the cabin so that a person standing in the cabin will be showered from four directions simultaneously. Beyond the high procuring costs, this type of shower has several disadvantages due to the fact that the nozzles are not individually adjustable and cannot be adapted to specific demands or to different body lengths. Moreover, this kind of shower-bath arrangement is extremely space consuming and in bathrooms in usual apartments there is usually no possibility of installating separate shower-bath arrangements of this kind. This is a severe drawback since a shower-bath has many advantages compared to a bath in a bathtub as well from a hygienical as from an energy saving point of view. In conventional bathrooms the shower bath fixtures are usually restricted to a handshower with specific holders for the shower grip to make it possible to take a shower bath standing in the bathtub. This kind of shower has, however, several disadvantages, due to the fact that the holder has to withstand considerable torques resulting from the reaction forces from the water jet. This has presented several problems to the designers. Moreover the shower nozzle of the hand shower is specifically designed for a close shower, which means that the water spray will be considerably scattered immediately after it has been discharged from the nozzle. Thus a hand shower held in position on the wall will cause considerable splash in a wide area around the bathtub. Thus, it will always be necessary to install shower curtains to prevent splashing over the entire bathroom floor when taking a shower-bath.

Beyond the above mentioned drawbacks previously known shower-bath fixtures are extremely uncomfortable for a physically disabled person, who perhaps by himself can neither hold the shower grip nor place it in the holder. In previously known stationary shower arrangements, with the exception of the above mentioned shower cabin, the bather must either turn around in the shower jet or turn the spray element from one side to the other to wet the whole body. This turning movement is extremely difficult to perform for a physically disabled and perhaps wheel-chair carried person. Neither is the above mentioned shower cabin specifically suitable for physically disabled persons since the nozzles are not adjustable in height and the cabin is not sufficiently wide to provide room for a wheel-chair. The most safe and convenient space for personal hygiene for a physically disabled person is undoubtedly in the bathtub sitting on a bench or the like specifically designed for this purpose. However, so far no fixtures have been designed which meet these specific requirements.

SUMMARY OF THE INVENTION

The main object of the present invention is to provide a shower bath arrangement which is simple, cheap and easy to install in bathrooms of conventional standard and which is adjustable in height for all body lengths and makes it possible to obtain effective water jets from several directions simultaneously to wet the whole body without need to turn either the bather or the apparatus. The arrangement according to the invention will also permit showering with considerably less splashing of the bathroom floor compared to conventional shower-bath arrangements.

Another object of the present invention is to permit a bather to take a shower bath without wetting the hair, and to permit a person standing outside the bathtub to shower the hair without wetting the rest of the body. These objects are realized in an arrangement substantially characterized in that the shower arm comprises at least two shower nozzles, being arranged to emit substantially conical water jets, which can strike one another angularly within a mixing zone being located between said nozzles, as seen in a horizontal projection.

A further object of the invention is to provide an arrangement in which the shower with an easy hand grip can be converted to a bidet for showering of the crotch.

These further objects are realized by an arrangement in which the shower arm is rotatable around a first substantially horizontal axis so disposed that the mixing area can be located either above or below said nozzles.

In a further suitable embodiment according to the invention the shower arm is U-shaped and provided with four substantially circular nozzles, which are positioned at the outer and inner ends of the leg portions of the U-shaped shower arm.

DETAILED DESCRIPTION

Figure 1:
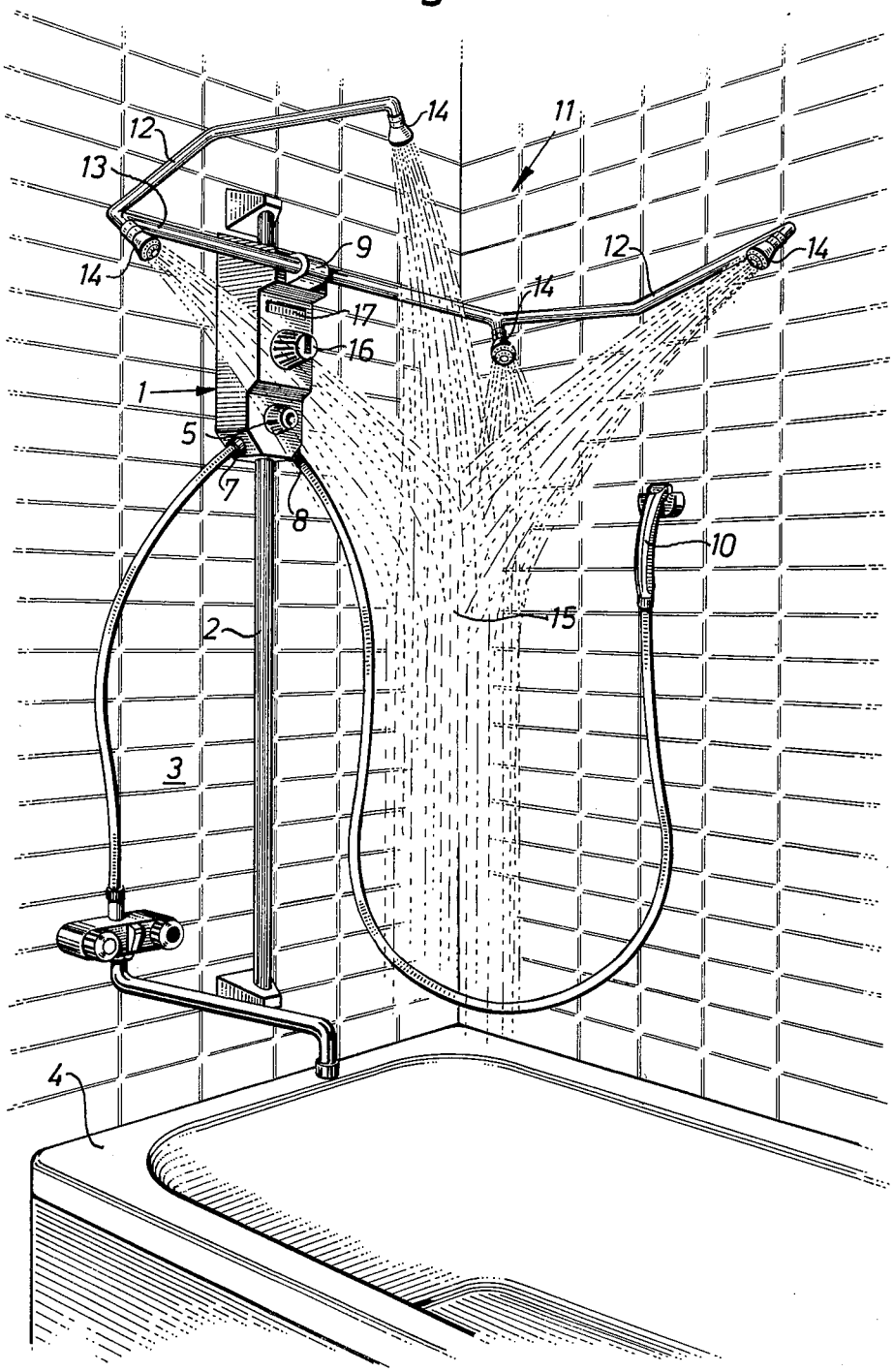
FIG. 1 is a perspective view of a shower-bath arrangement according to the invention; and, FIG. 2 is the shower-bath-arrangement according to FIG. 1 shown used in its bidet function.

As appears in FIG. 1 the shower-bath arrangement according to the invention comprises a slidable member 1, which is dislaceable on a vertical post 2 of suitable length, being mounted to a wall 3 above a bathtub 4. The slidable member 1 is further provided with a locking device 5 with which the slidable member 1 can be fixed at a suitable height on the post 2. The slidable member 1 is moreover provided with couplings 7 and 8 for connection to a water supply source, via coupling 7, and to a hand shower 10, via coupling 8, by means of flexible hoses. A further connection 9 supports a substantially U-shaped shower arm 11, which is provided with two leg portions 12 and a base portion 13. The connection 9 is formed with a substantially horizontal and tubular axle pin which serves as an inlet for the admission of water to said shower arm 11 and fits in a corresponding aperture in the slidable member 1. This arrangement enables a rotational movement of the shower arm 11 around the axle pin. The connection 9 is moreover designed as a bearing for the base portion 13 of the shower arm 11, which makes it possible to swing the leg portions upwards or downwards when the shower is not in use. It also provides a design, which permits a suitable setting of the inclination of the leg portions relative to the horizontal plane. The shower arm 11 supports four shower nozzles 14, which in this embodiment are positioned at the outer and inner ends of the leg portions 12 and which are rigidly connected to the shower arm 11. According to the invention the shower nozzles 14 are thus directed that the water jets from the nozzles are substantially conical and strike one another at oblique angles within a mixing area 15, which is located substantially at the same distance from the nozzles and symmetrically relative to the same. Since the shower arm 11 is pivotably connected to the slidable member 1 the area 15 within which the water jets mix can easily be positioned either below the nozzles 14, as appears on FIG. 1, or above them as appears on FIG. 2. In this latter case the shower-bath arrangement according to the invention is used in its bidet function.

The shower nozzles 14 are given such direction that the bather can easily adjust the height of the shower arm and thus the common mixing area 15 to be able to move freely out from and into the water jets without wetting the hair. Due to the fact that the jets are directed to strike one another at oblique angles in a common zone located substantially symmetrically relative to the nozzles, the jets will lose substantially all their energy of motion, thereby preventing scattering and splashing of water. The technical effect of this arrangement is most apparent and the shower according to the invention causes substantially less splash of the bathroom floor than any conventional shower-fixture.

Figure 2:
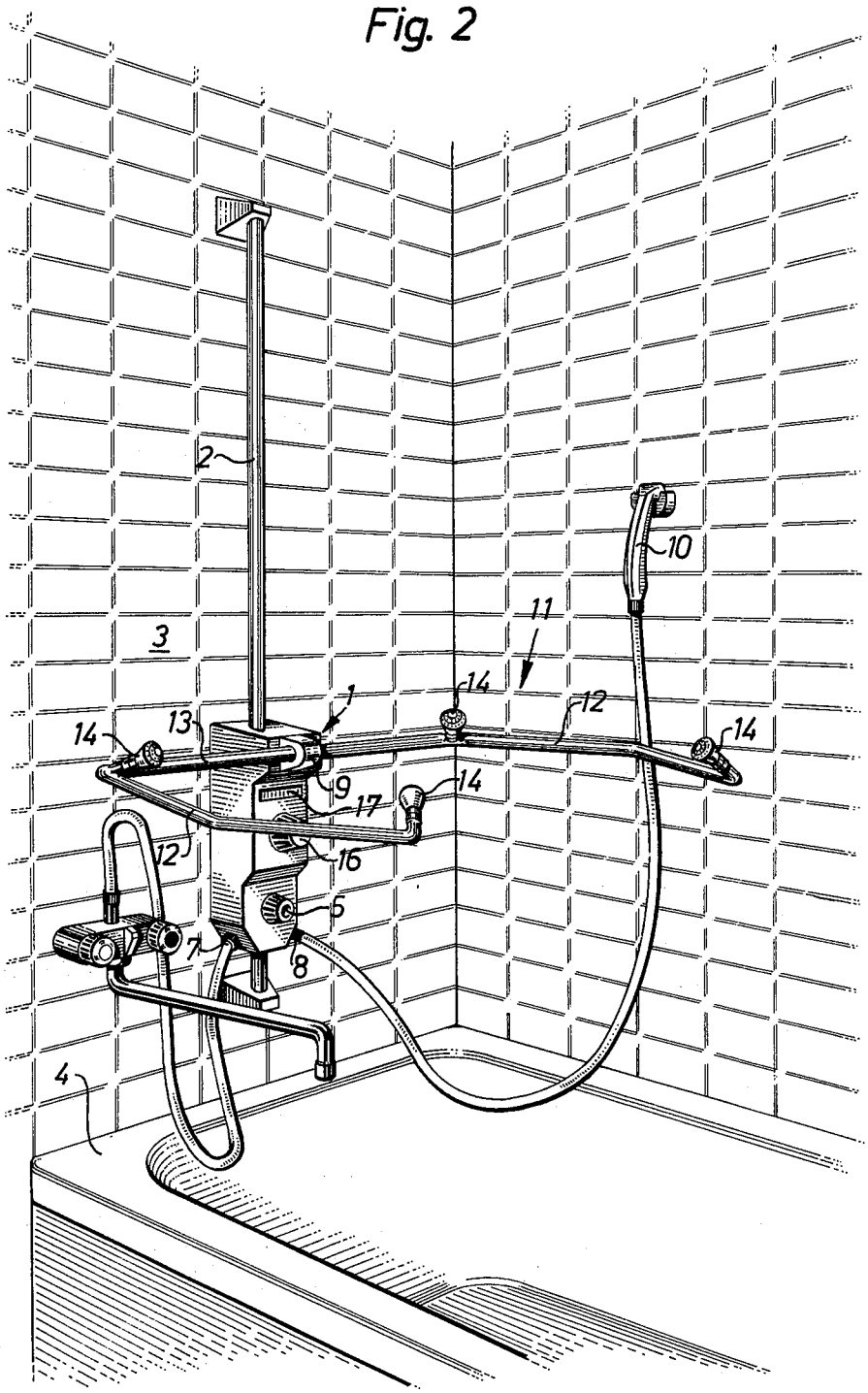

As appears from the figures the coupling 8 is connected to a hand shower 10 via a flexible hose and the slidable member 1 also comprises a switch valve 16 for change over between the hand shower 10 and the shower nozzles 14. The nozzles shown on FIGS. 1 and 2 are, as indicated above, rigidly connected to the arm out can preferably in other embodiments be adjustably connected to the same to provide an arrangement in which the nozzles can be individually set to obtain the desired shower function with the common mixing zone positioned either below or above the nozzles. With such an arrangement the bidet-function can be obtained by individual adjustment of the nozzles instead of the above-mentioned pivotal movement through 180° of the shower arm 11. It is also suitable to provide the nozzles with some kind of conventional restriction and turn off function so that the water flow through the nozzles can be individually set. The shower nozzles should moreover be designed to permit an adjustment of the conical form of the water jets.

In a suitable embodiment of the invention one of the leg portions of the U-shaped shower arm can be provided with the horizontal axle pin, instead of the base portion, to permit the rotational movement of the shower arm. The shower arm should moreover preferably be detachably connected to the slidable member, thereby permitting an easy exchange of shower arms.

In a further embodiment of the invention the U-shaped shower arm can be provided with two leg portions, which are journalled in the base portion and which can be individually turned relative to one another.

The slidable member 1 shown in FIGS. 1 and 2 is preferably swingable around the tubular post 2. This design has several advantages compared to an arrangement with a rigid rail mounted to the wall since an undeliberate violent touch of the shower arm in the swingable design only causes the slidable member 1 to rotate around the post 2, whereas in the latter design such a touch could cause strong and perhaps harmful damage to the shower arm and the rail. The slidable member can moreover be provided with a thermometer 17 and with a high-speed shut off device in case the water temperature should exceed a preselected and set value.

I claim:

1. Shower-bath arrangement, comprising:

a vertical support member;

a slidable member which is displaceable on said vertical support member and which is adjustable upwardly and downwardly on said vertical support member, said slidable member being provided with means for connection to a source of water supply;

a shower arm comprising at least two shower nozzles mounted thereon, said shower nozzles being arranged to emit substantially conical water jets, said nozzles being adjustable to direct said water jets to strike one another angularly within a mixing zone located between said nozzles, as seen in a horizontal projection; and pivotable mounting means for mounting said shower arm to said slidable member and defining with said shower arm a substantially horizontal axis about which at least a portion of said shower arm is swingable for adjustable setting of the inclination of at least said portion of said shower arm relative to the horizontal plane.

2. An arrangement according to claim 1, wherein said nozzles are located substantially symmetrically relative to said mixing zone, as seen in said horizontal projection.

3. An arrangement according to claim 1, wherein said shower arm is substantially U-shaped and is provided with four shower nozzles which are respectively positioned at the outer and inner ends of the leg portions of said substantially U-shaped shower arm.

4. An arrangement according to claim 1, wherein said mounting means includes means for rotatably mounting said shower arm around a second substantially horizontal axis which is substantially perpendicular to said first mentioned substantially horizontal axis so that said shower arm can be rotated to locate the mixing zone either above or below said nozzles.

5. An arrangement according to claim 1 comprising adjustable mounting means for mounting said shower nozzles to said shower arm such that the directions of said shower nozzles are separately adjustable in their mountings to said shower arm.

6. An arrangement according to claim 5, wherein each of said nozzles includes means for separately and individually controlling the water jet from each nozzle.

7. An arrangement according to claim 1, wherein said slidable member is provided with a locking arrangement cooperating with said support member for arbitrary height adjustment of said shower arm.

8. An arrangement according to claim 1, wherein said support member comprises a rod or rail, which is rigidly mounted to a wall and which supports said slidable member.

9. An arrangement according to claim 1, wherein said slidable member is provided with hose couplings for connection to a water pipe and a hand shower, and comprising a change-over valve for switching between supplying water to said shower nozzles and to said hand shower.

10. An arrangement according to claim 3 comprising adjustable mounting means for mounting said shower nozzles to said shower arm such that the directions of said shower nozzles are separately adjustable in their mountings to said shower arm.

11. An arrangement according to claim 2, wherein said shower arm is substantially U-shaped and is provided with four shower nozzles, which are respectively positioned at the outer and inner ends of the leg portions of said substantially U-shaped shower arm.

12. An arrangement according to claim 11 comprising adjustable mounting means for mounting said shower nozzles to said shower arm such that the directions of said shower nozzles are separately adjustable in their mountings to said shower arm.

13. An arrangement according to claim 12 wherein each of said nozzles includes means for separately and individually controlling the water jet from each nozzle.

14. An arrangement according to claim 1 further comprising means for rotating said shower nozzles to locate said mixing zone either above or below said nozzles.

15. An arrangement according to claim 14 wherein said means for rotating said shower nozzles includes means for rotating at least a portion of said shower arm about a substantially horizontal axis.

16. An arrangement according to claim 3 wherein the leg portions of said shower arm are swingable about said substantially horizontal axis.

17. An arrangement according to claim 1 wherein said shower arm is substantially U-shaped and includes a base portion with two leg portions extending therefrom, said base portion being mounted to said pivotable mounting means being rotatable about said horizontal axis for adjustable setting of the inclination of the shower arm relative to the horizontal plane.

18. An arrangement according to claim 17 wherein said leg portions and said base portion of said shower arm are rigidly connected together.

19. An arrangement according to claim 18 wherein said base portion of said shower arm includes first and second base portions which are individually mounted to said pivotable mounting means, each of said first and second base portions being individually swingable about said horizontal axis, one of said leg portions extending from an end of respective ones of said first and second base portions.

20. An arrangement according to claim 1 wherein said shower arm is comprised of first and second shower arm portions pivotally mounted to said pivotable mounting means and which are rotatable about said substantially horizontal axis for adjustable setting of the inclination of said shower arm portions relative to the horizontal plane.

21. An arrangement according to claim 20 wherein said first and second shower arm portions are individually rotatable about said substantially horizontal axis.

22. An arrangement according to claim 1 wherein said shower nozzles are adjustable to direct said water jets to strike one another to form said mixing zone substantially at the same distance from each of said nozzles and between said nozzles, as seen in a horizontal projection.

* * * * *